US010612430B2

(12) United States Patent
Stanhope

(10) Patent No.: US 10,612,430 B2
(45) Date of Patent: Apr. 7, 2020

(54) OIL CONTROL VALVE TO CONTROL A CAM PHASER WITH A SPOOL POSITIONED BY EXTERNAL ACTUATOR

(71) Applicant: ECO Holding 1 GmbH, Marktheidenfeld (DE)

(72) Inventor: Daniel Stanhope, Nunica, MI (US)

(73) Assignee: ECO Holding 1 GmbH, Marktheldenfeld (DE)

( * ) Notice: Subject to any disclaimer, the term of this patent is extended or adjusted under 35 U.S.C. 154(b) by 238 days.

(21) Appl. No.: 15/831,078

(22) Filed: Dec. 4, 2017

(65) Prior Publication Data

US 2018/0363514 A1 Dec. 20, 2018

Related U.S. Application Data

(60) Provisional application No. 62/522,624, filed on Jun. 20, 2017.

(51) Int. Cl.

| | |
|---|---|
| ***F01L 1/34*** | (2006.01) |
| ***F01L 1/344*** | (2006.01) |
| ***F01L 1/047*** | (2006.01) |

(52) U.S. Cl.

CPC ..... *F01L 1/3442* (2013.01); *F01L 1/047* (2013.01); *F01L 1/34409* (2013.01); *F01L 2001/0475* (2013.01); *F01L 2001/054* (2013.01); *F01L 2001/3443* (2013.01); *F01L 2001/3445* (2013.01); *F01L 2001/34433* (2013.01); *F01L 2001/34459* (2013.01); *F01L 2101/00* (2013.01); *F01L 2103/00* (2013.01)

(58) Field of Classification Search

CPC ..... F01L 1/3442; F01L 1/34409; F01L 1/047; F01L 2001/0475; F01L 2001/34459; F01L 2001/054; F01L 2001/34433

See application file for complete search history.

(56) References Cited

U.S. PATENT DOCUMENTS

| | | | | |
|---|---|---|---|---|
| 2006/0027773 | A1* | 2/2006 | Nordstrom | F01L 1/34 251/129.15 |
| 2010/0251981 | A1* | 10/2010 | McCloy | F01L 1/34409 123/90.17 |
| 2012/0227693 | A1* | 9/2012 | Scheidig | F01L 1/34409 123/90.15 |
| 2014/0311333 | A1 | 10/2014 | Hutzelmann et al. | |
| 2014/0311594 | A1 | 10/2014 | Hutzelmann et al. | |

(Continued)

FOREIGN PATENT DOCUMENTS

| | | | |
|---|---|---|---|
| DE | 102010022896 | A1 | 12/2011 |
| DE | 102013104573 | A1 | 11/2014 |
| DE | 102013104575 | A1 | 11/2014 |

(Continued)

*Primary Examiner* — Zelalem Eshete
(74) *Attorney, Agent, or Firm* — Von Rohrscheidt Patents

(57) ABSTRACT

An oil control valve for a cam phaser of an internal combustion engine where the spool is positioned by an external actuator. The pressure enters the end of the oil control valve where the resultant pressure force is balanced by the differential area of the spool. The spool contains two plate check valves enabling cam torque recirculation of oil from A to B or B to A depending upon the spool position. In mid position, the spool lands block A and B to hold the cam phaser position. Three or five positions may be utilized.

15 Claims, 14 Drawing Sheets

(56) References Cited

U.S. PATENT DOCUMENTS

| | | | | |
|---|---|---|---|---|
| 2016/0130989 | A1* | 5/2016 | Fischer | F01L 1/3442 123/90.15 |
| 2017/0260882 | A1 | 9/2017 | Brower et al. | |

FOREIGN PATENT DOCUMENTS

| | | | |
|---|---|---|---|
| EP | 2966272 | A2 | 3/2014 |
| EP | 2966272 | A2 | 1/2016 |
| JP | 2012122454 | A | 8/2012 |

* cited by examiner

OIL CONTROL VALVE TO CONTROL A CAM PHASER WITH A SPOOL POSITIONED BY EXTERNAL ACTUATOR

RELATED APPLICATIONS

This application claims priority from, and incorporates by reference, U.S. provisional application Ser. No. 62/522,624 filed Sep. 19, 2017.

FIELD OF THE INVENTION

The invention relates to an oil control valve for a cam phaser of an internal combustion engine where the spool is positioned by an external actuator.

BACKGROUND OF THE INVENTION

Hydraulic valves for cam phasers for internal combustion engines are well known in the art. The hydraulic valve includes a piston that is axially movable in a housing of the hydraulic valve and that controls a hydraulic loading of the cam phaser. Hydraulic valves come in many different configurations. The housing is configured hollow cylindrical. The piston is also configured hollow cylindrical. Controlling the cam phaser is done hydraulically by positioning the flowable piston and opening and closing connections configured in the housing accordingly.

The publication documents DE 10 2013 104 573 A1 and DE 10 2013 104 575 A1 disclose a hydraulic valve which includes a supply connection at a housing end so that direct flowing of the piston received in the housing and thus straight loading of the piston with a hydraulic fluid that is fed through the supply connection can be provided. The piston has a complex outer geometry so that pressure forces are balanced to minimize pressure effect on the piston position.

The publication documents US 2014/0311333 A1 and US 2014/0311594 A1 disclose a hydraulic valve which includes check valves that are configured at a circumference of the piston. This either requires a complex housing configuration for receiving and securing the check valves or the housing is configured in plural components and requires a high level of assembly complexity. The piston is configured from multiple components and the individual components are joined concentrically which requires complex assembly since axial misalignments have to be avoided when the components are pressed together.

Another hydraulic valve which includes so called center position locking can be derived from the publication document EP 2 966 272 A2. The piston has a complex external geometry since additional locking connections are arranged in the housing of the hydraulic valve.

Another hydraulic valve which includes a particular piston for a hydraulic valve for a cam phaser may be found in Patent Application US 2017/0260882 A1 filed on Nov. 26, 2016, which is incorporated herein in its entirety. This hydraulic valve also invented by the inventor of this application has many common features of the present invention.

BRIEF SUMMARY OF THE INVENTION

An object of the invention is to provide a hydraulic valve for a cam phaser including a spool assembly including a spool that is axially movable in a central opening, and a first check valve and a second check valve which prevent an unintentional outflow of a hydraulic fluid flowing through the spool assembly from an inner cavity of the spool assembly in a first flow through an opening and a second flow though the opening of the spool assembly associated respectively with a first operating connection and a second operating connection. The spool assembly has a first position, a second position, and a third position. The hydraulic fluid can flow from the first operating connection to the second operating connection when the spool assembly is in the first position, the hydraulic fluid does not flow between the first operating connection and the second operating connection when the spool assembly is in the second position, and the hydraulic fluid can flow from the second operating connection to the first operating connection when the spool assembly is in the third position. The first operating connection and the second operating connection are opened and closed according to a position of the spool assembly. A supply connection may be arranged at an end of the hydraulic valve. The spool assembly may include a machined spool. The spool assembly may include other spool parts made of plastic such as stamped or deep drawn plastics. The other parts made of plastic may be a supply tube and flow disk. The spool may be positioned by external actuation. A pressured hydraulic fluid may enter an end of the hydraulic valve where resultant pressure force is balanced by a differential area of the spool. The first check valve and the second check valve may enable cam torque recirculation of hydraulic fluid. The hydraulic valve may be an oil control valve or an internal combustion engine oil control valve. The spool assembly may have a first additional position and a second additional position where the first additional position is located between the first position and the second position and where the second additional position is located between the second position and the third position. The hydraulic fluid flows from the first operating connection to the second operating connection when the spool assembly is in the first additional position, and the hydraulic fluid flows from the second operating connection to the first operating connection when the spool assembly is in the second additional position. A tank connection may also be included where the tank connection is open when the spool assembly is in the first position or third position, and where the tank connection is closed when the spool assembly is in the first additional position, second position, or second additional position.

Another object of the invention is to provide hydraulic valve for a cam phaser including a spool assembly including a spool that is axially movable in a central opening, and a first check valve and a second check valve which prevent an unintentional outflow of a hydraulic fluid flowing through the spool assembly from an inner cavity of the spool assembly in a first flow through an opening and a second flow though the opening of the spool assembly associated respectively with a first operating connection and a second operating connection. The spool assembly has a first position, a second position, a third position, a fourth position and a fifth position. The hydraulic fluid flows from the first operating connection to the second operating connection when the spool assembly is in the first position or the second position, the hydraulic fluid does not flow between the first operating connection and the second operating connection when the spool assembly is in the third position, and the hydraulic fluid flows from the second operating connection to the first operating connection when the spool assembly is in the fourth position or the fifth position. The first operating connection and the second operating connection are opened and closed according to a position of the spool assembly and a pressure across the first check valve and the second check valve. The hydraulic valve may also include a tank connection. The tank connection is open when the spool assembly is in the first position or fifth position, and the tank connection is closed when the spool assembly is in the second position, third position, or fourth position.

BRIEF DESCRIPTION OF THE DRAWINGS

Other advantages, features and details of the invention can be derived from the subsequent description of advantageous embodiments and from the drawing figures. The features and feature combinations recited in the preceding description and the features and feature combinations recited and shown individually in the figure description and in the figures are not only usable in the respectively recited combination but also in other combinations or by themselves without departing from the spirit and scope of the invention. Identical or functionally equivalent elements are designated with identical reference numerals. For reasons of clarity it is possible that elements are not designated with reference numerals in all figures without losing their association, wherein.

9

Figure 8:
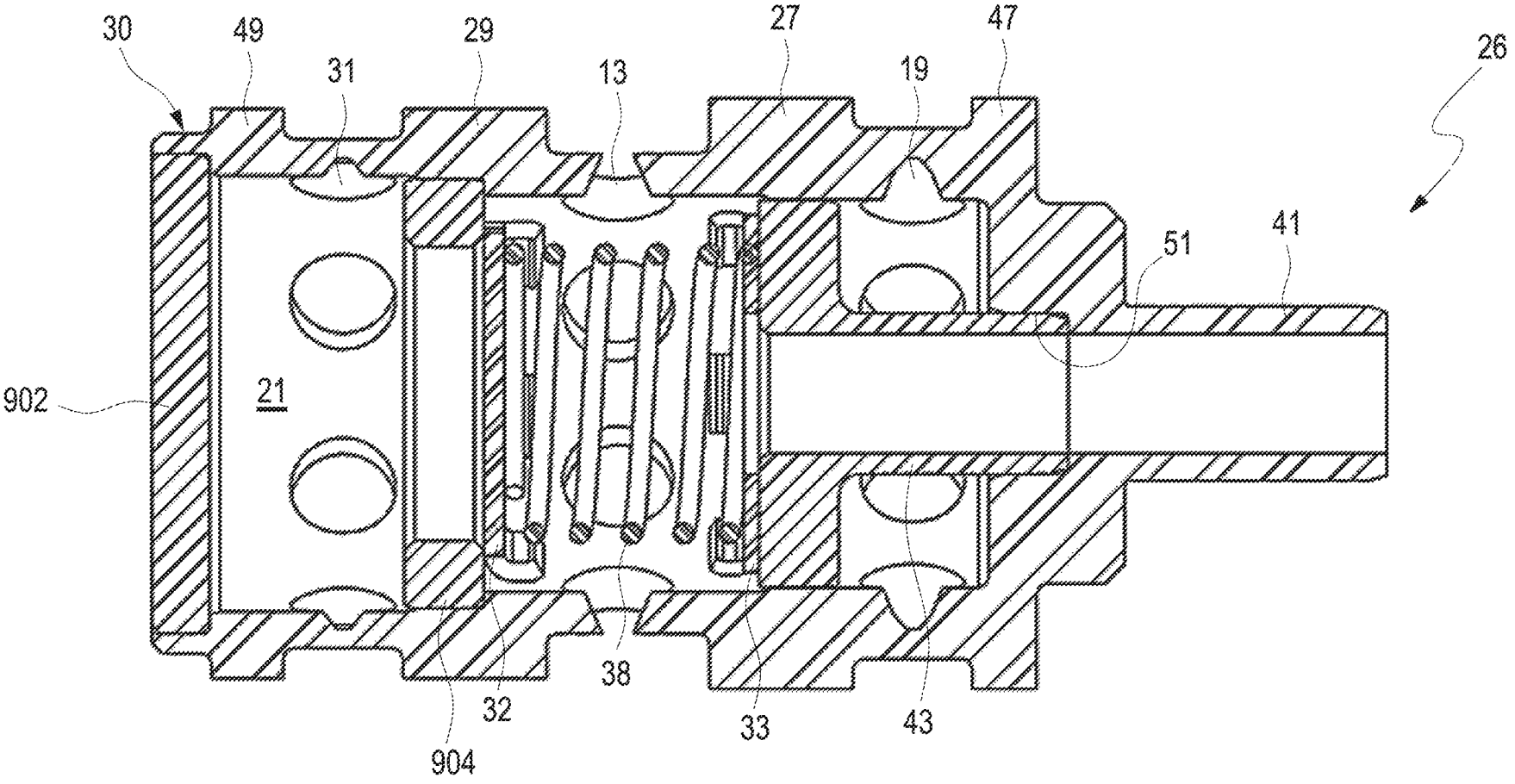
Figure 9:
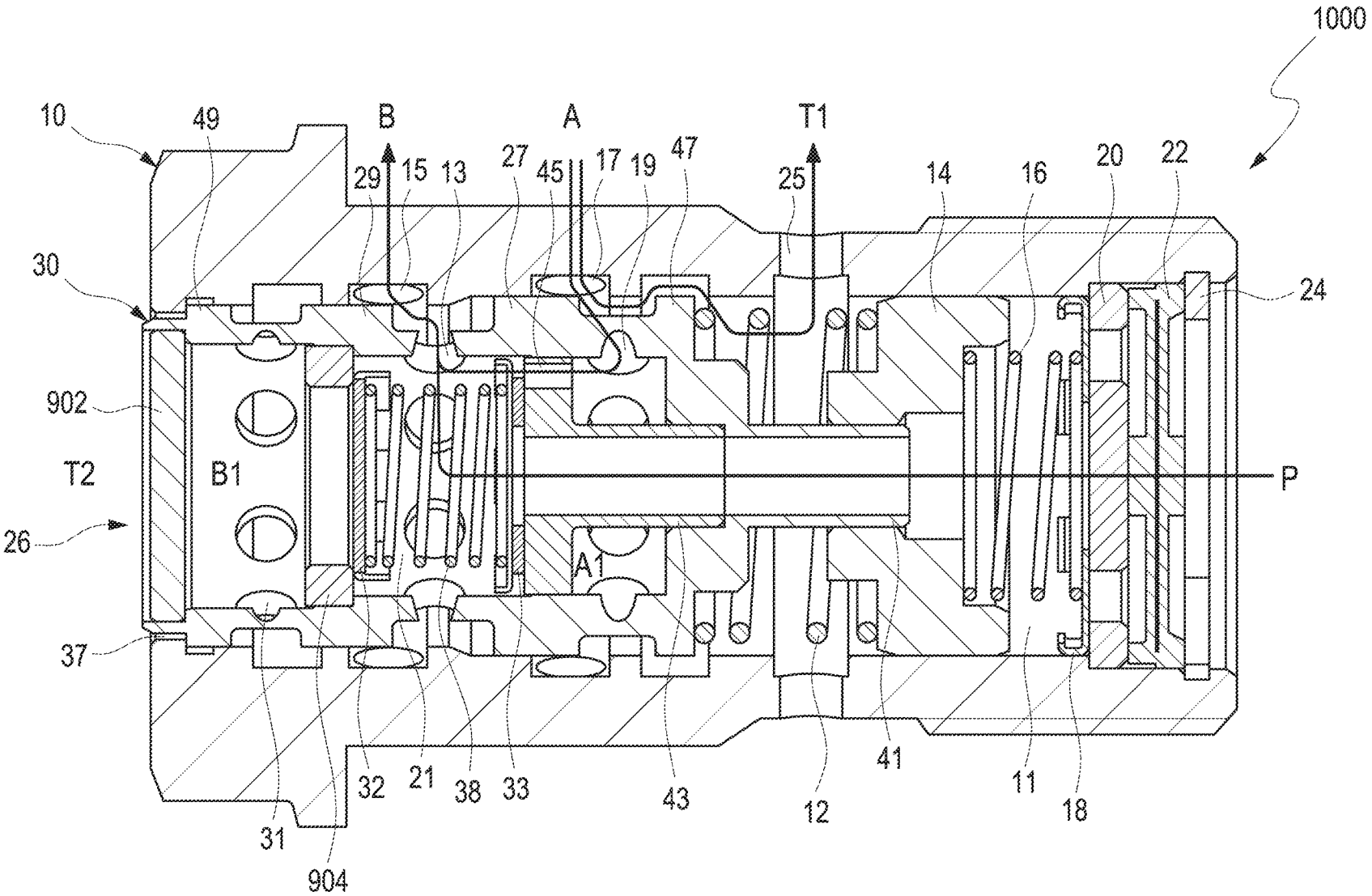
Figure 10:
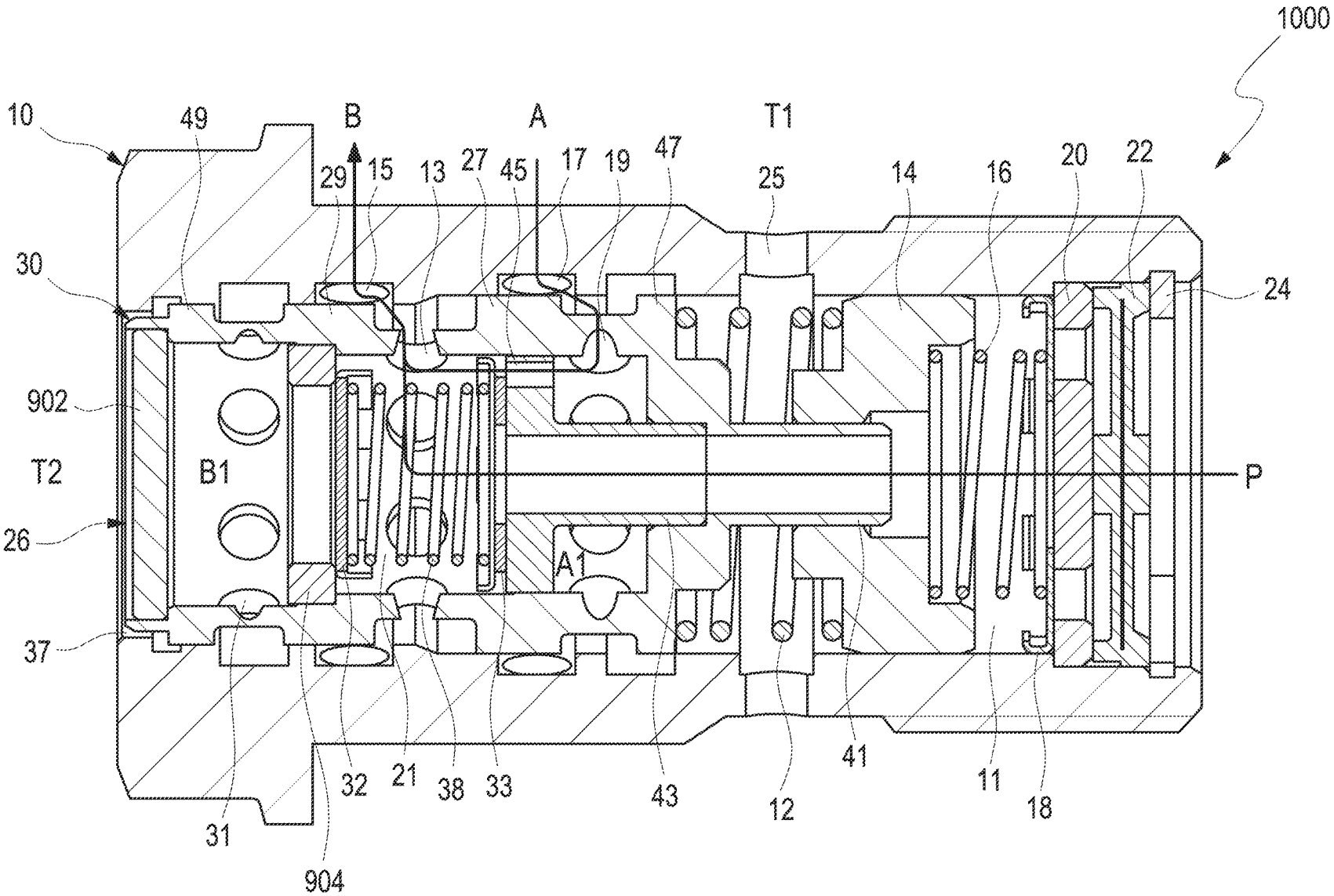
Figure 11:
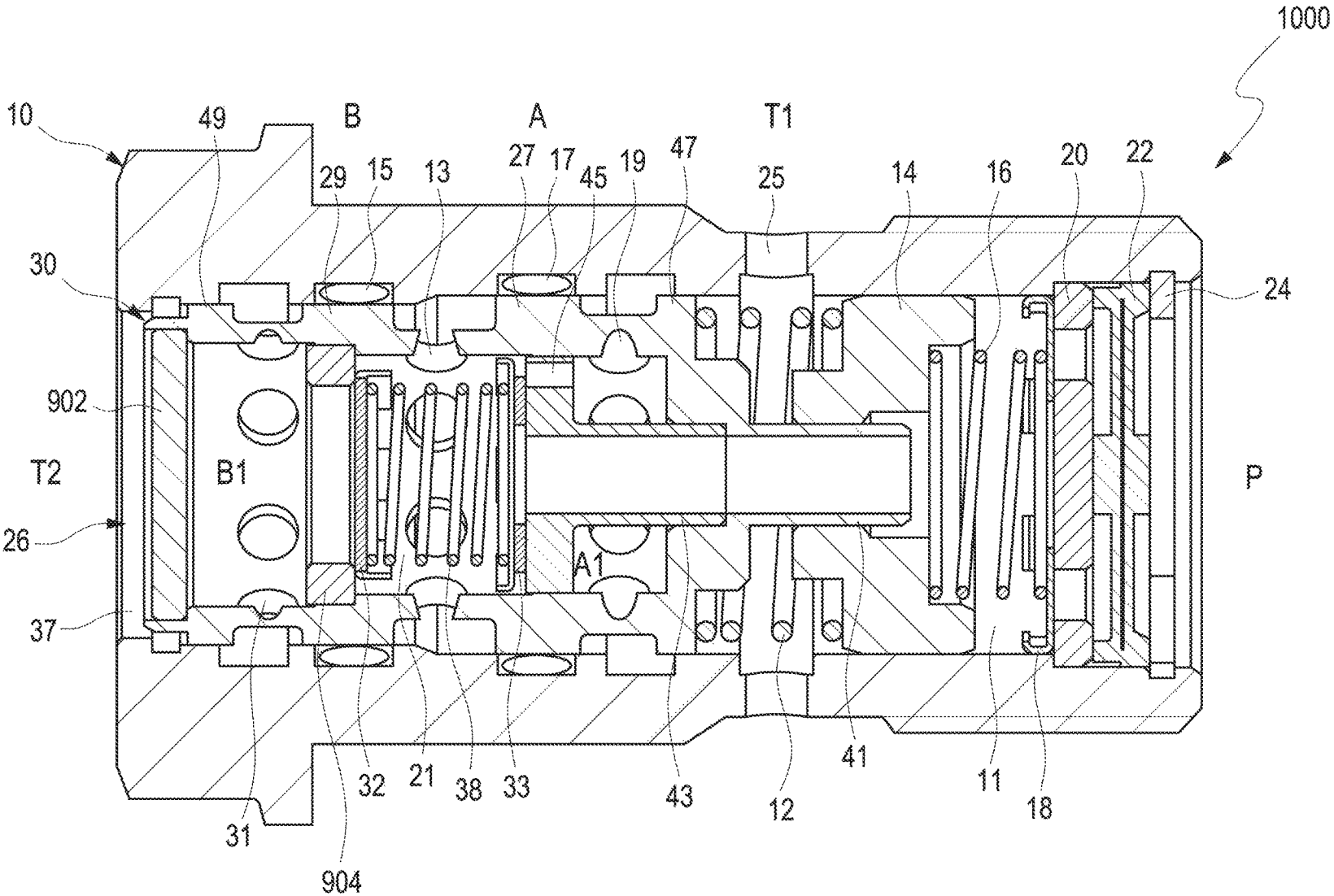
Figure 12:
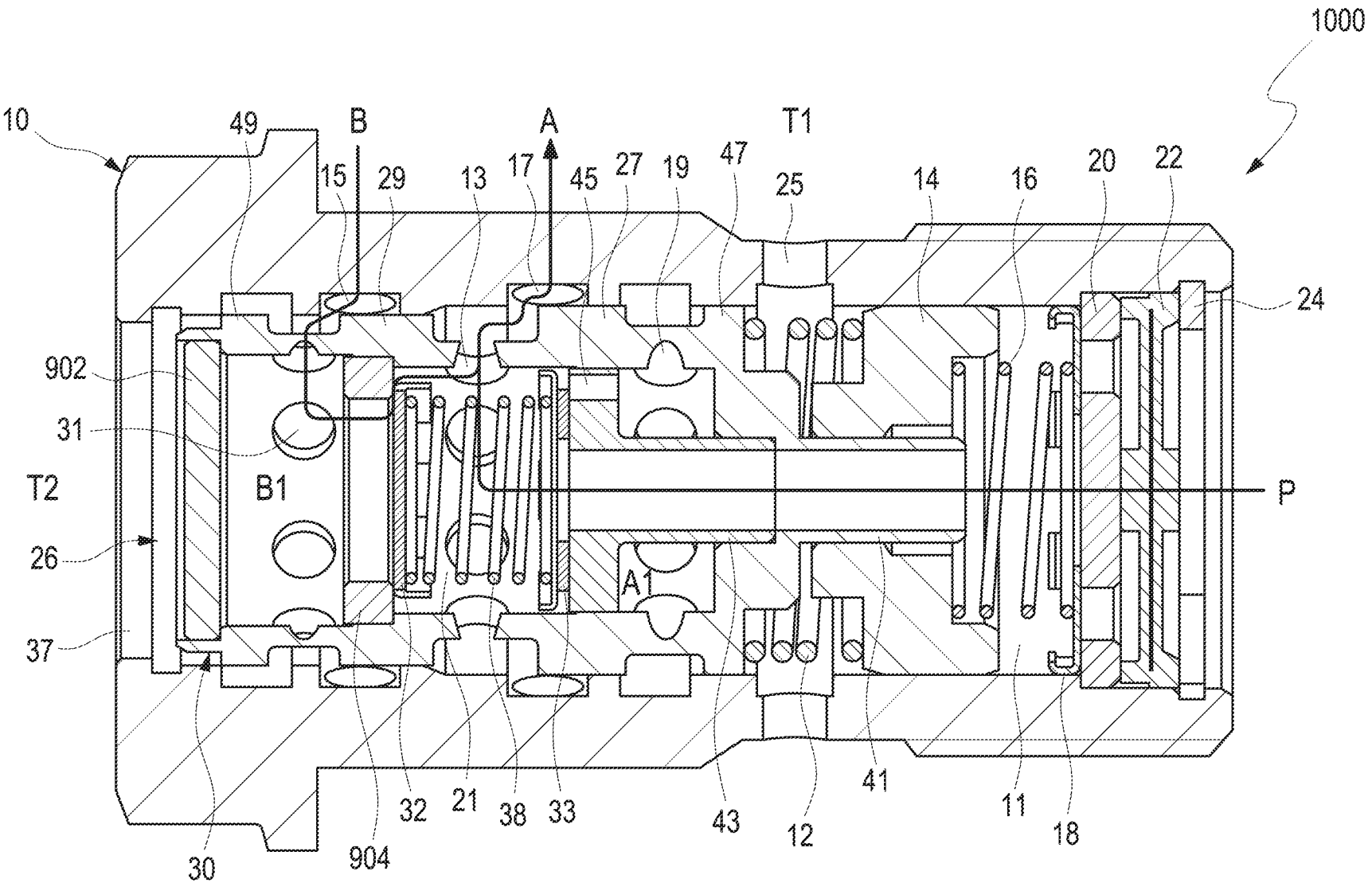
Figure 13:
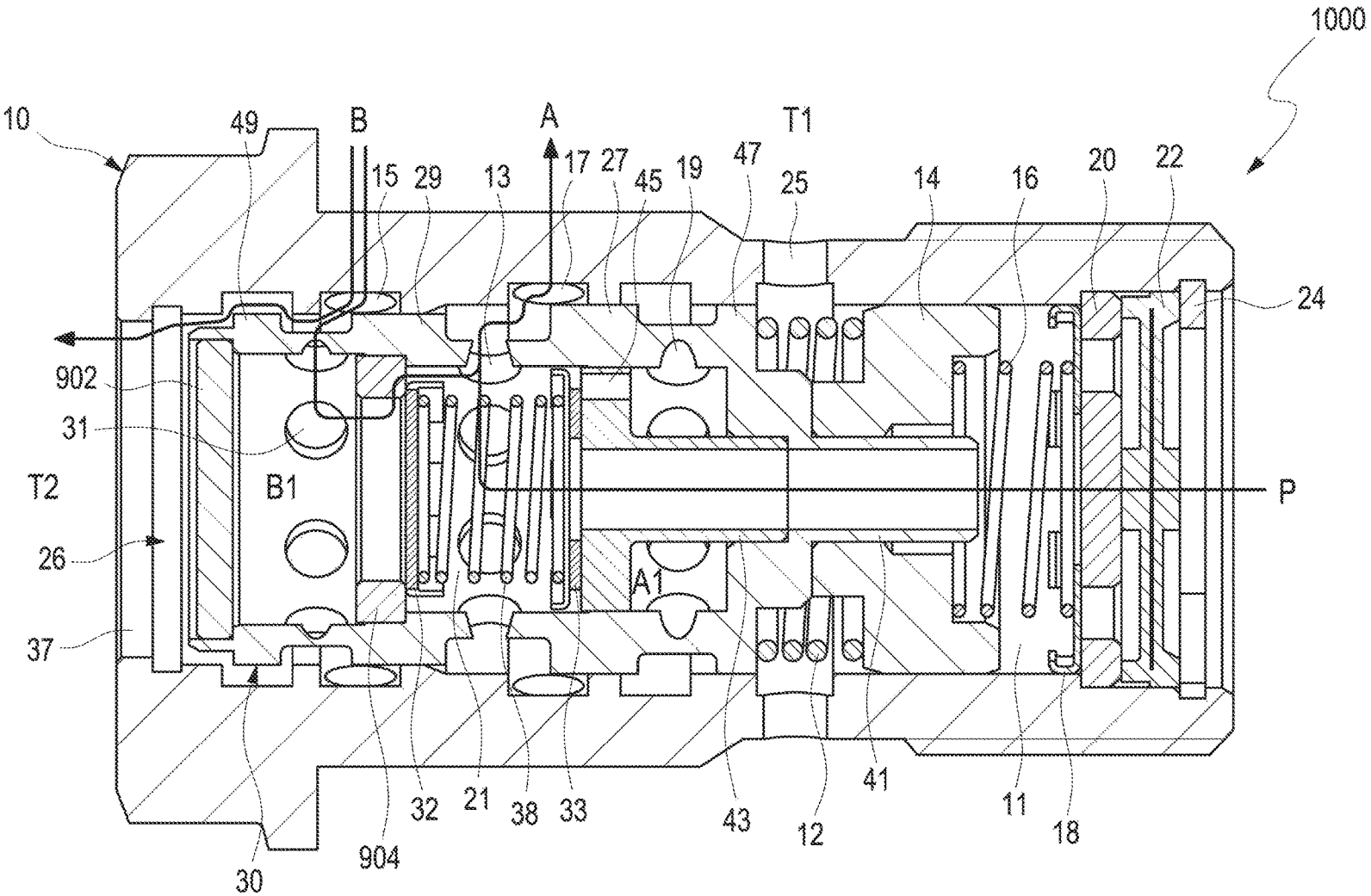
Figure 14:
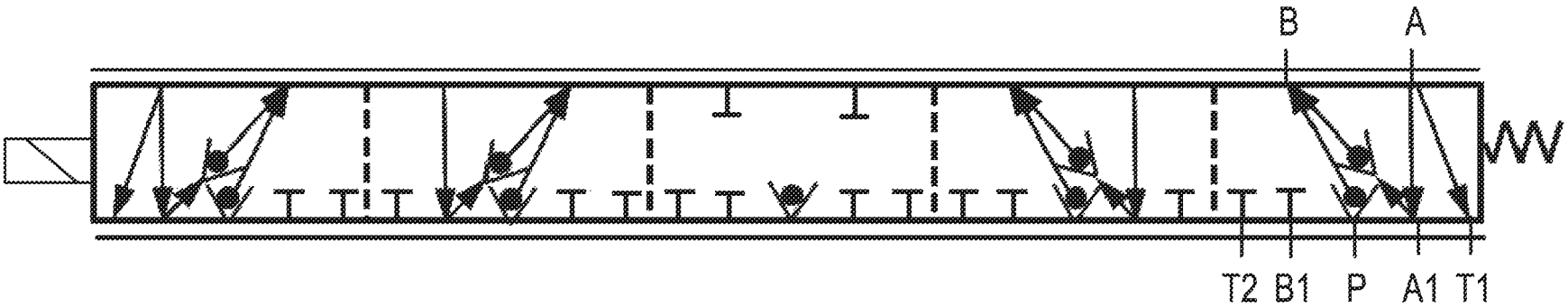
Figure 15:
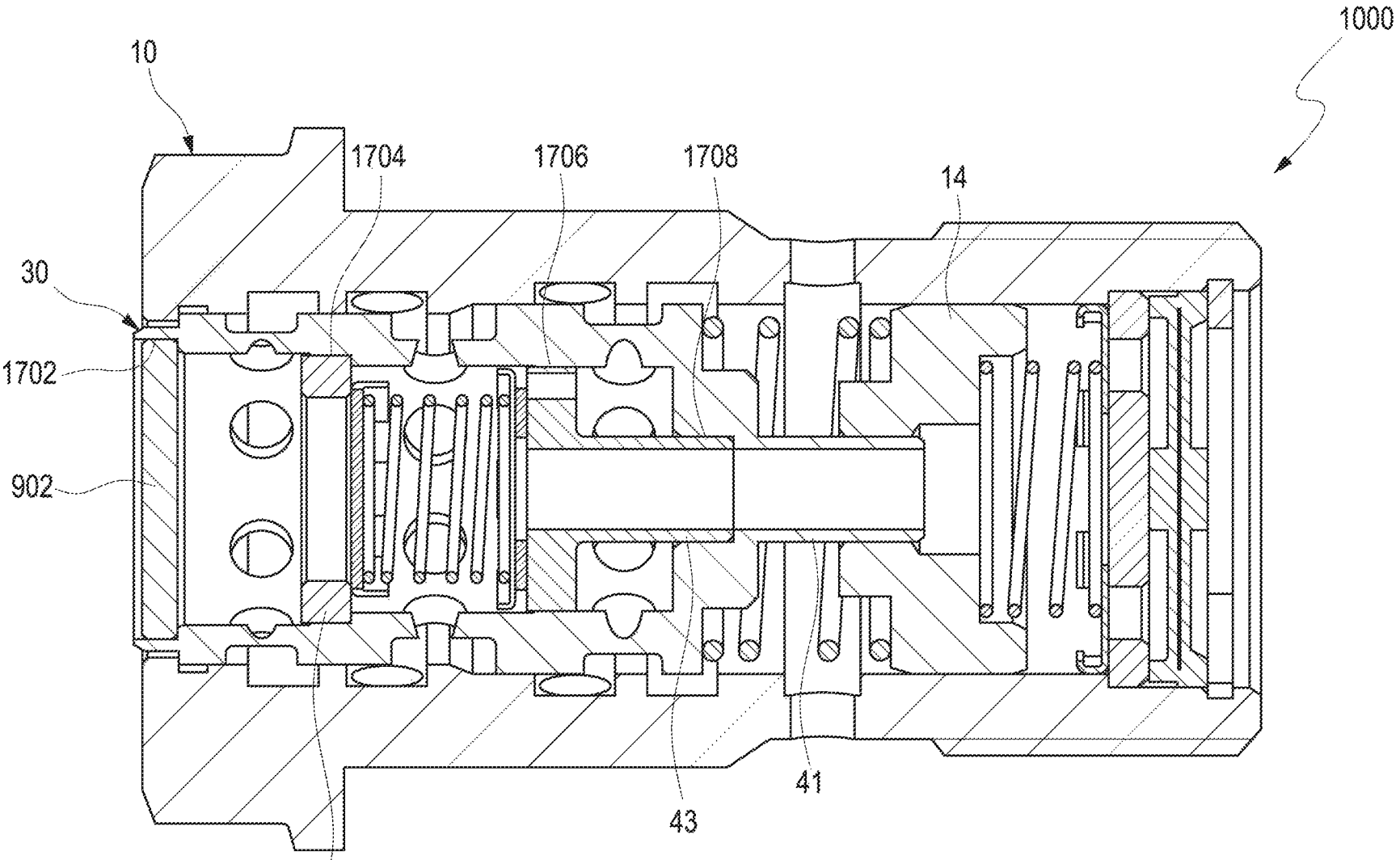

FIG. 8 illustrates an assembled view of an oil control valve for a cam phaser of an internal combustion engine according to a second embodiment of the invention with the oil control valve put together;

FIG. 9 illustrates the oil control valve according to a second embodiment of the invention with a 0 mm travel (starting or first position);

FIG. 10 illustrates the oil control valve according to a second embodiment of the invention with a 0.6 mm travel (second position);

FIG. 11 illustrates the oil control valve according to a second embodiment of the invention with a 1.5 mm travel (middle or hold position);

FIG. 12 illustrates the oil control valve according to a second embodiment of the invention with a 2.7 mm travel (fourth position);

FIG. 13 illustrates the oil control valve according to a second embodiment of the invention with a 3.2 mm travel (fifth position or end position);

FIG. 14 illustrates a symbol view of the oil control valve according to a second embodiment of the invention in various positions; and FIG. 15 illustrates the oil control valve 1000 according to a second embodiment of the invention that utilizes various securing methods

DETAILED DESCRIPTION OF THE INVENTION

The invention relates to an oil control valve for a cam phaser of an internal combustion engine where the spool is positioned by an external actuator. The pressure enters the end of the oil control valve where the resultant pressure force is balanced by the differential area of the spool. The spool contains two plate check valves enabling cam torque recirculation of oil from A to B or B to A depending upon the spool position. In middle position, the spool lands block A and B to hold the cam phaser position.

Figure 1:
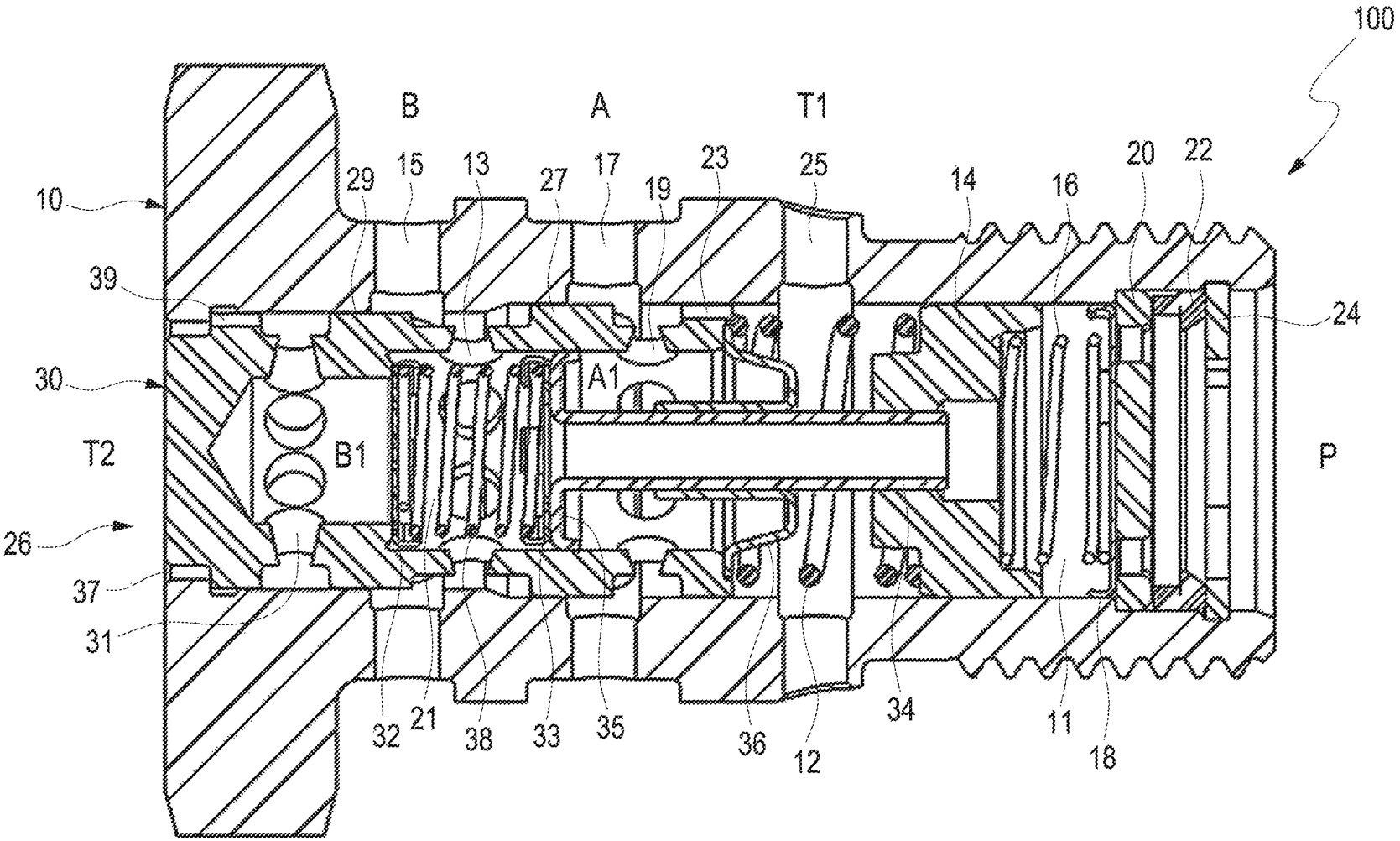
FIG. 1 illustrates an assembled view of an oil control valve for a cam phaser of an internal combustion engine with the oil control valve put together.

FIG. 1 illustrates an assembled view of an oil control valve 100 for a cam phaser of an internal combustion engine. The oil control valve includes a central valve housing 10, a spring 12, a calibration cap 14, a spring 16, a check valve 18, a flow disk 20, a supply filter 22, a snap ring 24, a spool assembly 26, a spool 30 having lands for blocking oil flow and grooves for allowing oil flow, check valve 32, check valve 33, a supply tube 34 and flow disk 35, a cal-stop 36, and a spring 38. The plate check valves 32, 33 are axially arranged in the spool 30 and have opposite opening directions. They abut on a recess of the spool 30, the flow disk 35 or a separate check valve disc 904 (see FIG. 8) alternatively.

Figure 2:
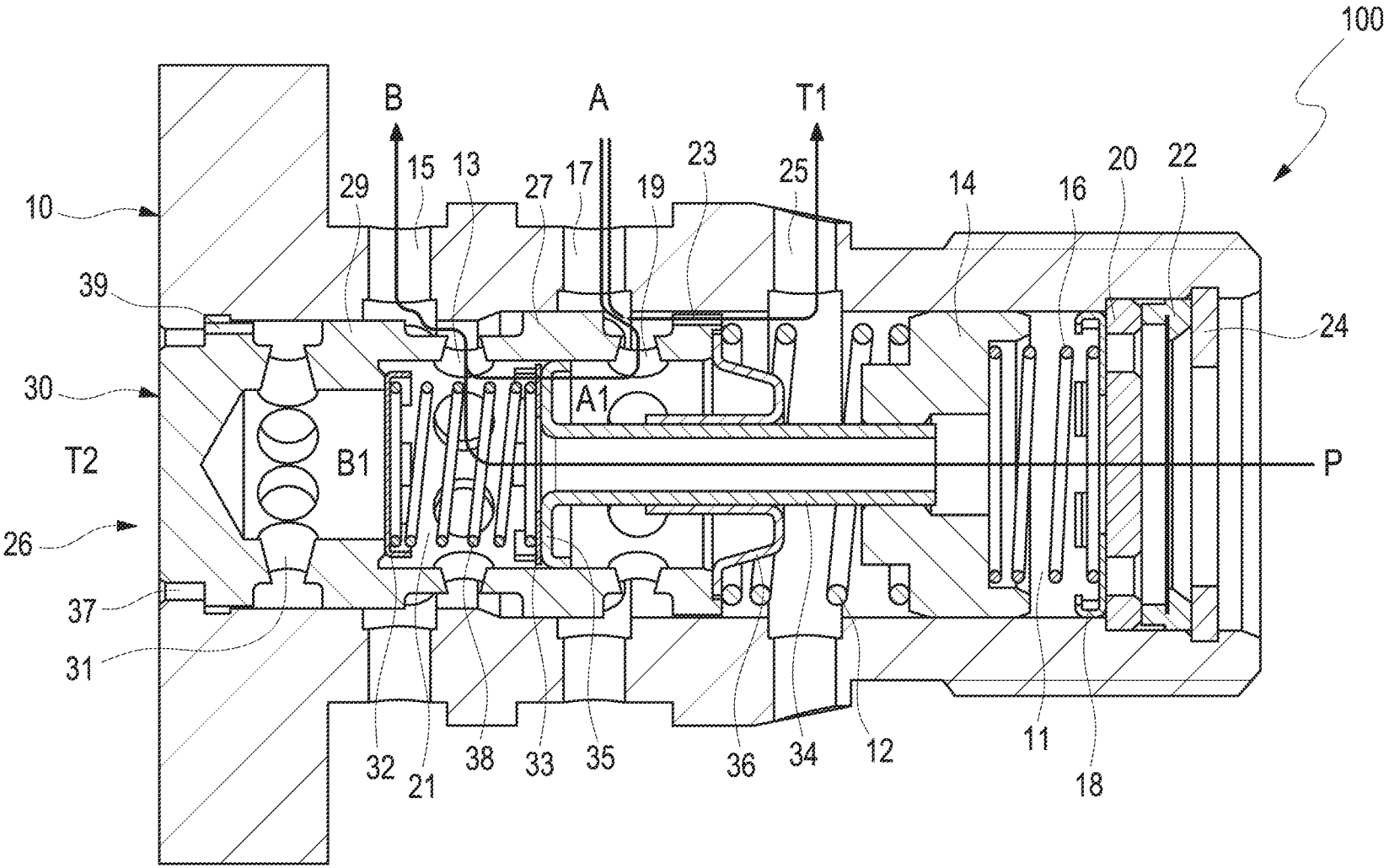
FIG. 2 illustrates an oil control valve with a 0 mm travel (starting position)

FIG. 2 illustrates the oil control valve 100 with a 0 mm travel (starting position). In the starting position, the two plate check valves result in the cam torque recirculation of oil from A to B. In order to hydraulically supply the cam phaser plural connections A, B, P, T1 (located in the center of the housing 10), T2 (located on the left end) are provided.

Figure 3:
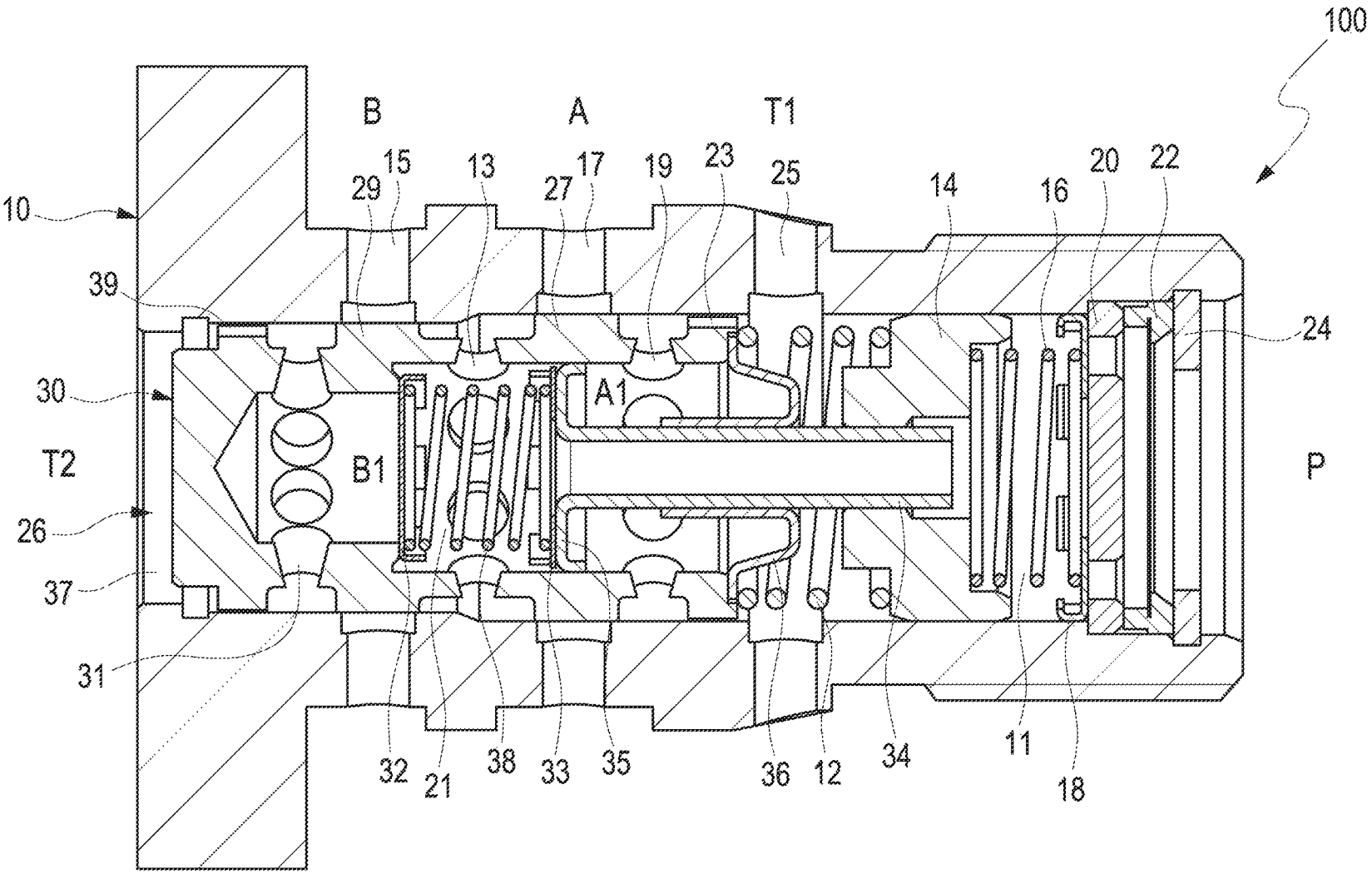
FIG. 3 illustrates the oil control valve with a 1.5 mm travel (middle position)

FIG. 3 illustrates the oil control valve 100 with a 1.5 mm travel (middle or hold position). In middle position, the spool lands block A and B to hold the cam phaser position. There is no recirculation or exhaust in the middle position.

Figure 4:
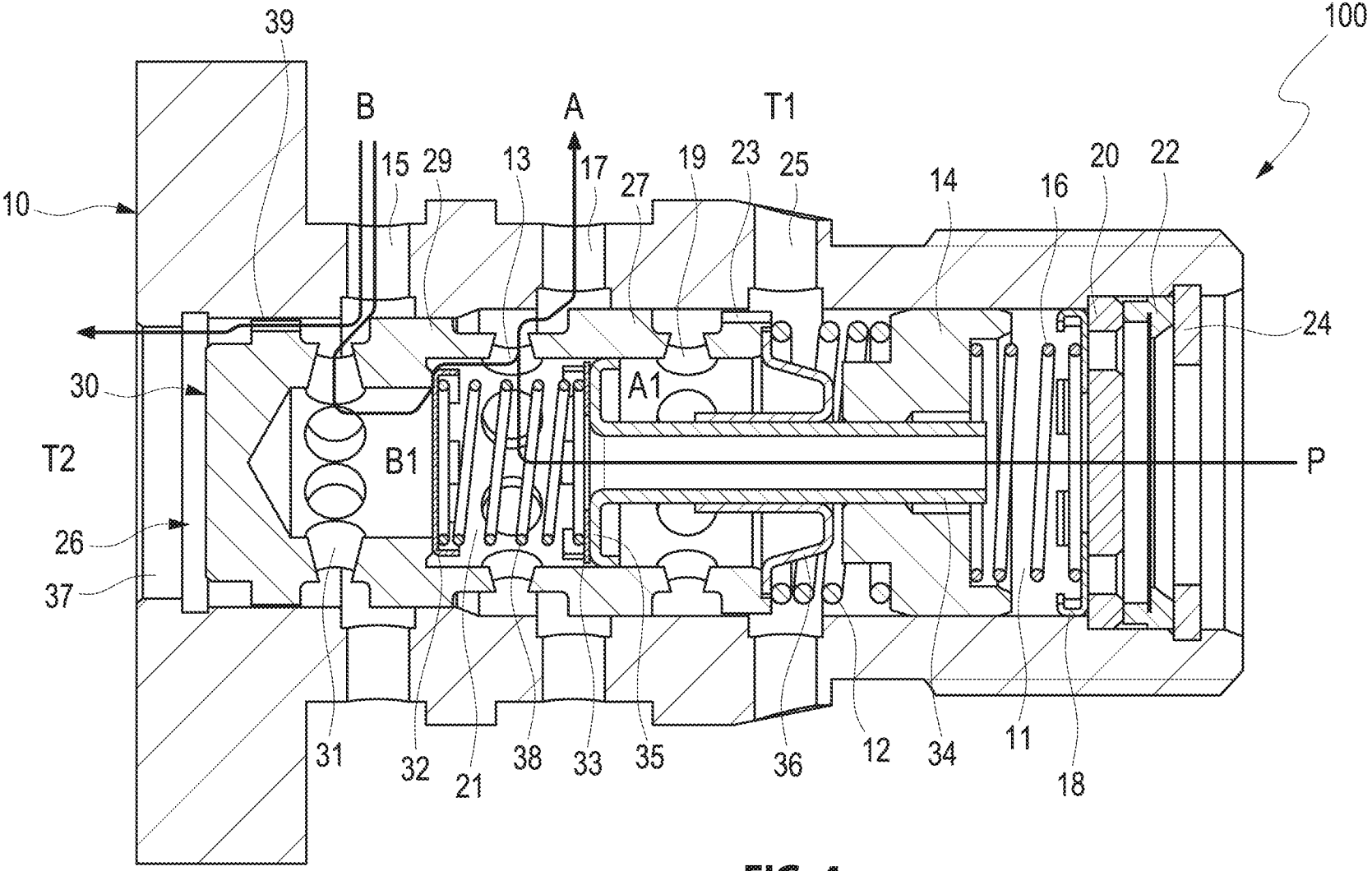
FIG. 4 illustrates the oil control valve with a 3 mm travel (end position)

FIG. 4 illustrates the oil control valve 100 with a 3 mm travel (end position). In the end position, the two plate check valves result in the cam torque recirculation of oil from B to A.

Figure 5:
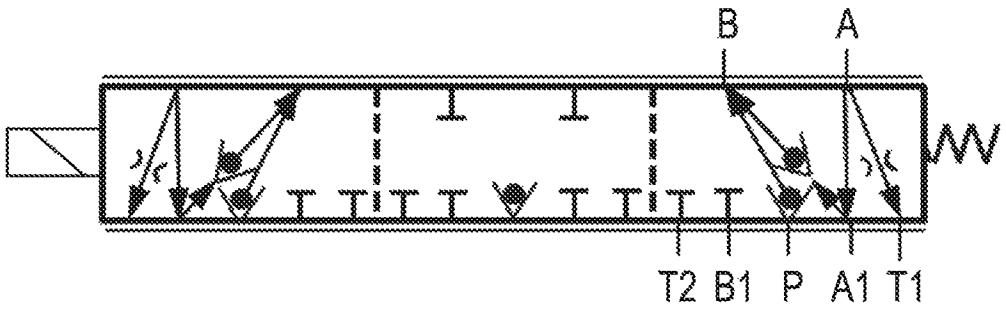
FIG. 5 illustrates a symbol view of the oil control valve in various positions.

FIG. 5 illustrates a symbol view of the oil control valve 100 in various positions. The right section of the symbol view illustrated in FIG. 5 illustrates a flow through of the oil control valve 100 according to a starting (first) position illustrated in FIG. 2. The middle section of the symbol view illustrated in FIG. 5 illustrates a flow through of the oil control valve 100 according to a middle (second) position illustrated in FIG. 3. The left section of the symbol view illustrated in FIG. 5 illustrates a flow through of the oil control valve 100 according to an end (third) position illustrated in FIG. 4.

In the starting position according FIG. 2 the second operating connection B is loaded with hydraulic fluid. This means the hydraulic fluid flows from the first supply connection P through an inner space 11 of the housing 10, the supply tube 34 and a first flow through opening 13 of the spool 30 which releases a second connection opening 15 of the housing 10 connected with the second operating connection B. Furthermore hydraulic fluid can flow from the first operating connection A at least partially through a first connection opening 17 of the housing 10, a second flow through opening 19 (A1) of the spool 30, the flow disc 35 and by opening the right most check valve 33 the hydraulic fluid can flow from an inner space 21 of the spool 30 into the first flow through opening 13. From there the hydraulic fluid flows through the second connection opening 15 into the second operating connection B. The additional portion of the fluid flowing out of the first operating connection A flows through opening 17 and a first drain channel 23 of the spool 30 into a third connection opening 25 associated with a tank connection T1 right next to the first connection opening 17 in the housing 10.

In the middle or hold position according FIG. 3, the flows are stopped due to the position of lands 27, 29 of the spool 30.

Figure 6:
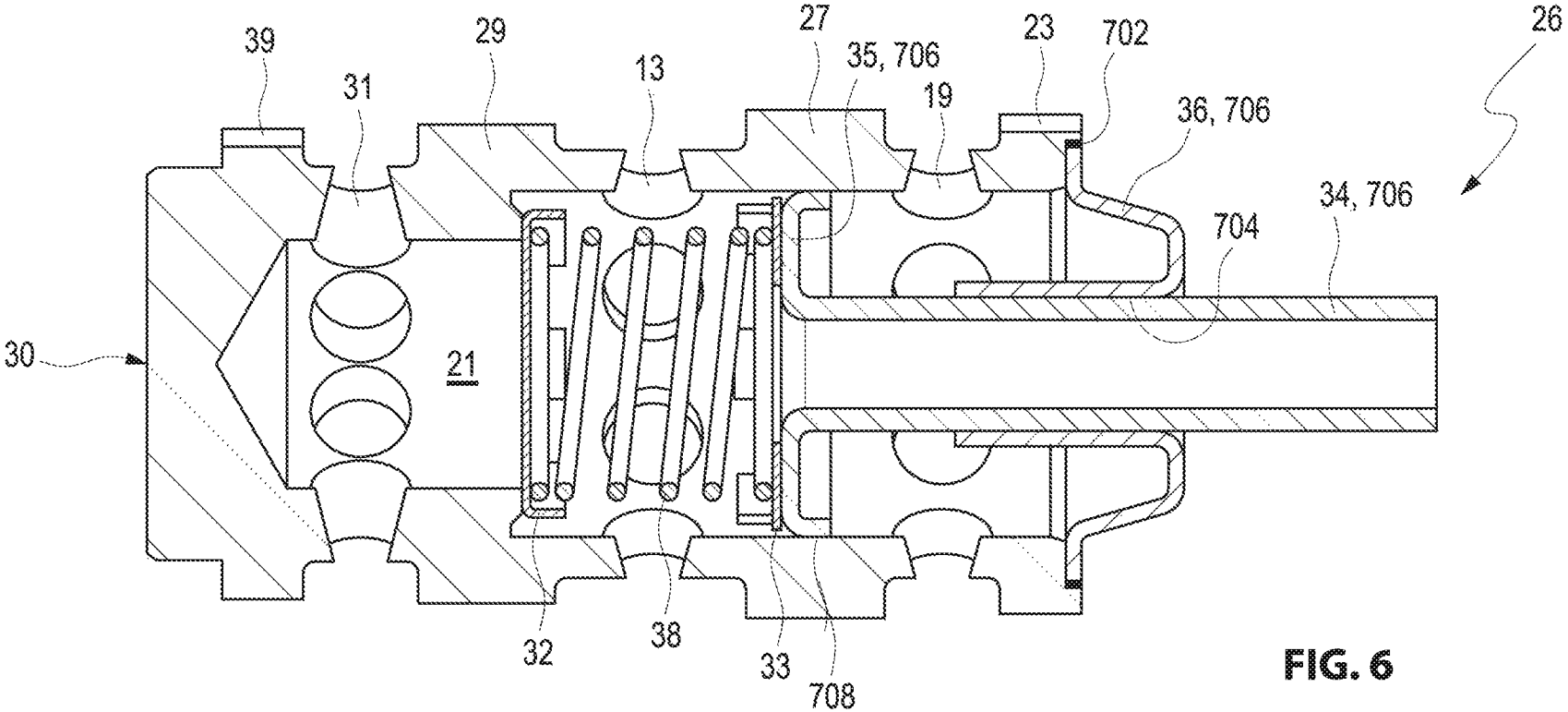
FIG. 6 illustrates an exemplary spool assembly.

In the end position according FIG. 4 the first operating connection A is loaded with hydraulic fluid. This means the hydraulic fluid flows from the first supply connection P through the inner space 11 and the supply tube 34 into the inner space 21 of the spool 30 and the first flow through opening 13 which releases the first connection opening 17 connected with the first operating connection A. Furthermore hydraulic fluid can flow from the second operating connection B at least partially through the second connection opening 15, a third flow through opening 31 (B1) of the spool 30 and by opening the left most check valve 32 the hydraulic fluid can flow into the inner space 21 into the first flow through opening 13. From there the hydraulic fluid flows through the first connection opening 17 into the first operating connection A. The additional portion of the fluid flowing out of the second operating connection B flows through opening 15 and a second drain channel 39 of the spool 30 into a fourth connection opening 37 of the housing 10 associated with the tank connection T2 on the left. FIG. 6 illustrates an exemplary spool assembly 26. A laser weld 702 is a 360 degrees weld to hold the spool 30 and cal-stop 36 in place and sealed against leaks. A weld or press 704 to secure the supply tube 34. Some of the parts may be made from stamped or deep drawn parts 706. The supply tube 34 and flow disk 35 may be made as a single part from plastic. The flow disk 35 is pressed lightly (press 708) into the spool 30 for oil sealing. Retention may be done by a welded stop.

Figure 7:
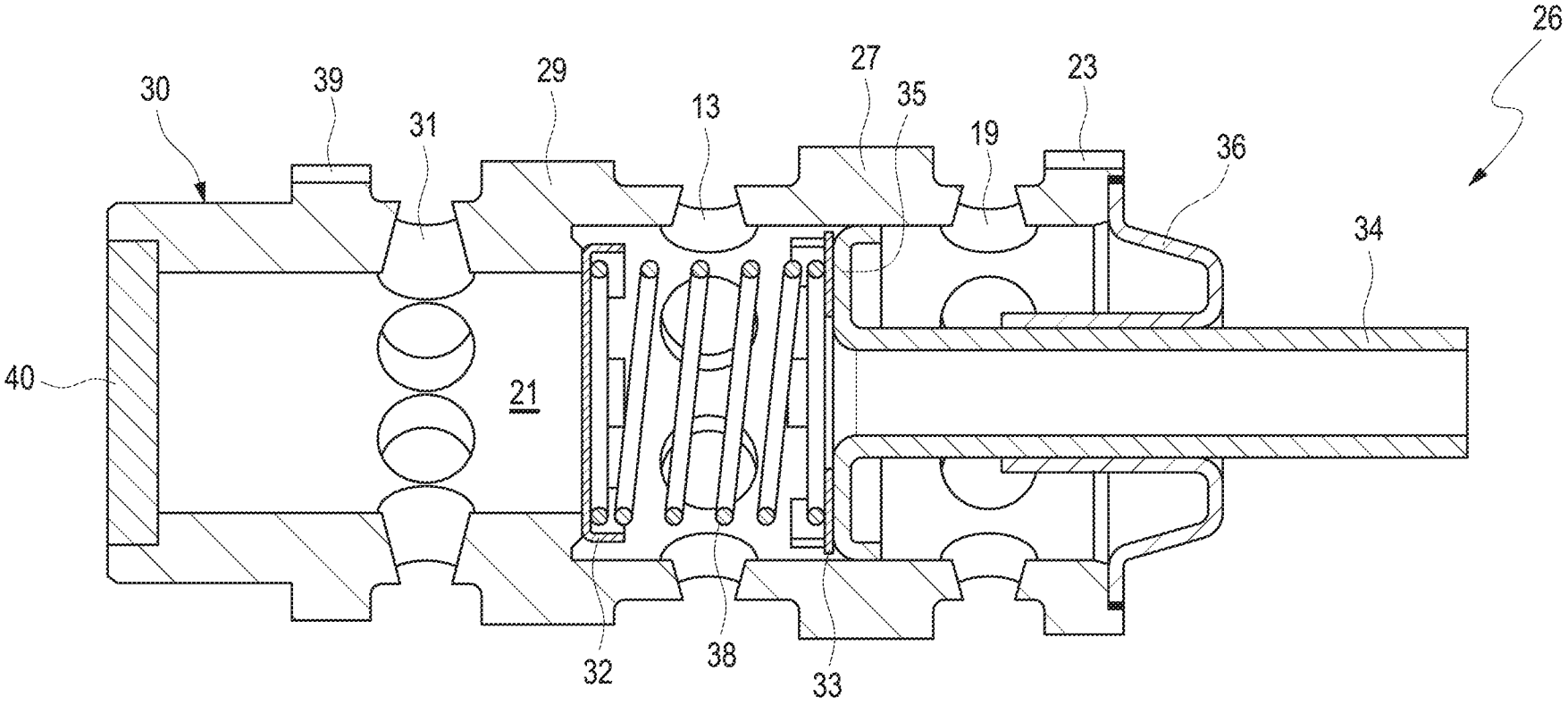
FIG. 7 illustrates another exemplary spool assembly.

FIG. 7 illustrates another exemplary spool assembly. The spool assembly (sometimes called a piston) includes an alternative spool that is easier to machine and easier to cleaning without a blind bore. The spool 30 according FIG. 7 is a hollow piston with two open ends. A disc 40 is fixed into the spool 30 and seals the inner space 21 at the left end.

FIG. 8 illustrates an assembled view of an oil control valve 1000 for a cam phaser of an internal combustion engine according to a second embodiment of the invention. The oil control valve includes a central valve housing 10, a spring 12, a calibration cap 14, a spring 16, a check valve 18, a flow disk 20, a supply filter 22, a snap ring 24, a spool assembly 26, a spool 30 having lands for blocking oil flow and grooves for allowing oil flow, check valves 32 and 33, a spring 38, a disk 902, a check valve disk 904, and a check valve tube 43. This oil control valve 1000 has an alternative spool assembly 26 that retains the check valves 32, 33. The inner diameter of the spool 30 is easier to machine providing a lower cost spool assembly 26.

FIG. 9, FIG. 10, FIG. 12 and FIG. 13 illustrate positions on either side of "hold" position (no exhaust) of FIG. 11. The positions shown in FIG. 9 and FIG. 13 illustrate the tank opening at both ends of the stroke. This operation is beneficial particularly in four cylinder applications where Cam torque recirculation benefits low engine speed phase rate and oil pressure actuation benefits high engine speed phase rate. This function may be added to various spool designs.

FIG. 9 illustrates the oil control valve 1000 according to a second embodiment of the invention with a 0 mm travel (starting or first position). In the first position, hydraulic fluid flows from supply connection P through a spool extension 41, which is guided in the calibration cap 14, the check valve tube 43, the first flow though opening 13 of the spool and the second connection opening 15 to second operating connection B. Right end of the check valve tube 43 is positioned in a recess 51 of the spool 30. The plate check valve 33 opens for a cam torque recirculation of oil from A to B via first connection opening 17, second flow through opening 19, openings 45 of the check valve tube 43 (see dotted lines in FIG. 9), inner space 21, first flow though opening 13 to the second connection opening 15. In order to hydraulically supply the cam phaser plural connections A, B, P, T1 (located right next to connection A in the housing 10), T2 (located on the left end of the housing 10) are provided. T1 is open which allows flow from A over a right end land 47 to the third connection opening 25 and T1.

FIG. 10 illustrates the oil control valve 1000 according to a second embodiment of the invention with a 0.6 mm travel (second position). In the second position, the plate check valve 33 results in the cam torque recirculation of oil from A to B. In contrast to the first position according FIG. 9 the flow to the third connection opening 25 and thus T1 is closed by the right end land 47 of the spool 30.

FIG. 11 illustrates the oil control valve 1000 according to a second embodiment of the invention with a 1.5 mm travel (middle or hold position). In this position, the spool lands 27, 29 block A and B to hold the cam phaser position. There is no recirculation in the middle or hold position.

FIG. 12 illustrates the oil control valve 1000 according to a second embodiment of the invention with a 2.7 mm travel (fourth position). In the fourth position, the plate check 32 valves results in the cam torque recirculation of oil from B to A. T2 is closed by a left end land 49 of the spool 30.

FIG. 13 illustrates the oil control valve 1000 according to a second embodiment of the invention with a 3.2 mm travel (end position). In the end position, hydraulic fluid flows from supply connection P through a spool extension 41, the check valve tube 43, the first flow though opening 13 of the spool and the first connection opening 17 to first operating connection A. The plate check valve 32 opens for cam torque recirculation of oil from B to A via second connection opening 15, third flow through opening 31, check valve 32, inner space 21, first flow though opening 13 to the first connection opening 17. T2 is open which allows flow from B over the left end land 49 to the fourth connection opening 37 and T2.

FIG. 14 illustrates a symbol view of the oil control valve 1000 according to a second embodiment of the invention in various positions. The far right section of the symbol view illustrated in FIG. 14 illustrates a flow through of the oil control valve 1000 according to a first position illustrated in FIG. 9. The section next to the far right section of the symbol view illustrated in FIG. 14 illustrates a flow through of the oil control valve 1000 according to a second position illustrated in FIG. 10. The middle section of the symbol view illustrated in FIG. 14 illustrates a flow through of the oil control valve 1000 according to a middle (third) position illustrated in FIG. 11. The section to the left of the middle section of the symbol view illustrated in FIG. 14 illustrates a flow through of the oil control valve 1000 according to a fourth position illustrated in FIG. 12. The far left section of the symbol view illustrated in FIG. 14 illustrates a flow through of the oil control valve 1000 according to a fifth (end or last) position illustrated in FIG. 13.

In this starting position the second operating connection B is loaded with hydraulic fluid. This means the hydraulic fluid flows from the first supply connection P through an inner space and the first flow through opening which releases the second connection opening connected with the second operating connection B. Furthermore hydraulic fluid can flow from the first operating connection A at least partially through the first connection opening and by opening the right most check valve 32 the hydraulic fluid can flow into the inner space into the first flow through the opening. From there the hydraulic fluid flows through the second connection opening into the second operating connection B. The additional portion of the fluid flowing out of the first operating connection A flows through opening into a third connection opening associated with the tank connection T1.

The second position operates similar to the starting position except that the tank connection T1 is closed.

In this middle or hold position, the flows are stopped.

In this end or fifth position the first operating connection A is loaded with hydraulic fluid. This means the hydraulic fluid flows from the first supply connection P through an inner space and the second flow through opening which releases the second connection opening connected with the first operating connection A. Furthermore hydraulic fluid can flow from the second operating connection B at least partially through the second connection opening and by opening the left most check valve 32 the hydraulic fluid can flow into the inner space into the first flow through the opening. From there the hydraulic fluid flows through the first connection opening into the first operating connection A. The additional portion of the fluid flowing out of the second operating connection B flows through opening into a fourth connection opening associated with the tank connection T2 on the left. The additional portion of the hydraulic fluid flowing into the tank connection T2 on the left flows out of the second operating connection B.

The fourth position operates similar to the fifth position except that the tank connection T2 is closed.

FIG. 15 illustrates the oil control valve 1000 according to a second embodiment of the invention that utilizes various securing methods. Specifically, a crimp or spot weld may be used at a first location 1702, a spot weld or press may be used at a second location 1704, a spot weld or press may be used at a third location 1706, and a press may be used at a fourth location 1708.

The invention has a number of advantages including being low cost, having a good flow of recirculated oil, and ease of assembly. The spool assembly may be manufactured at low cost. More specifically, the spool 30 is machined while the other spool parts in the spool assembly may be made by more cost effective methods such as being stamped, or being deep drawn, or any other suitable cost effective methods, and the other spool parts in the spool assembly may be made of plastics or any other suitable inexpensive material or materials.

The good flow of recirculated oil occurs because the axial check valves 18, 32, 33 allow flow improvement over other valves such as band check valves. The invention is easier to assemble because of the concentricity of supply tube to the spool can be maintained by fixture tooling during stop welding.

Although several embodiments of the present invention and its advantages have been described in detail, it should be understood that changes, substitutions, transformations, modifications, variations, permutations and alterations may be made therein without departing from the teachings of the present invention, the spirit and the scope of the invention being set forth by the appended claims.

What is claimed is:

1. A hydraulic valve for a cam phaser comprising:

a spool assembly including a spool that is axially movable in a central opening; and a first check valve and a second check valve which prevent an unintentional outflow of a hydraulic fluid flowing through the spool assembly from an inner cavity of the spool assembly in a first flow through an opening and a second flow though the opening of the spool assembly associated respectively with a first operating connection and a second operating connection;

wherein the spool assembly has a first position, a second position, and a third position, wherein the hydraulic fluid flows from the first operating connection to the second operating connection when the spool assembly is in the first position, wherein the hydraulic fluid does not flow between the first operating connection and the second operating connection when the spool assembly is in the second position, wherein the hydraulic fluid flows from the second operating connection to the first operating connection when the spool assembly is in the third position, wherein the first operating connection and the second operating connection are opened and closed according to a position of the spool, and wherein the first check valve and the second check valve are axially arranged in the spool.

2. The hydraulic valve according to claim 1, further comprising a supply connection is arranged at an end of the hydraulic valve.

3. The hydraulic valve according to claim 1, wherein the spool assembly includes a machined spool.

4. The hydraulic valve according to claim 1, wherein the spool assembly includes other spool parts made of plastic.

5. The hydraulic valve according to claim 4, wherein the other parts made of plastic are made of stamped or deep drawn plastics.

6. The hydraulic valve according to claim 4, wherein the other parts made of plastic are a supply tube and a flow disk.

7. The hydraulic valve according to claim 1, wherein the spool is positioned by external actuation.

8. The hydraulic valve according to claim 1, wherein pressured hydraulic fluid enters an end of the hydraulic valve where resultant pressure force is balanced by a differential area of the spool.

9. The hydraulic valve according to claim 1, wherein the first check valve and the second check valve enabling cam torque recirculation of hydraulic fluid.

10. The hydraulic valve according to claim 1, wherein the hydraulic valve is an oil control valve.

11. The hydraulic valve according to claim 1, wherein the hydraulic valve is an internal combustion engine oil control valve.

12. The hydraulic valve according to claim 1, wherein the spool assembly has a first additional position and a second additional position, the first additional position being located between the first position and the second position, and the second additional position being located between the second position and the third position, wherein the hydraulic fluid flows from the first operating connection to the second operating connection when the spool assembly is in the first additional position, and wherein the hydraulic fluid flows from the second operating connection to the first operating connection when the spool assembly is in the second additional position.

13. The hydraulic valve according to claim 12, further comprising:

a tank connection, wherein the tank connection is open when the spool assembly is in the first position or third position, and wherein the tank connection is closed when the spool assembly is in the first additional position, second position, or second additional position.

14. A hydraulic valve for a cam phaser comprising:

a spool assembly including a spool that is axially movable in a central opening; and a first check valve and a second check valve which prevent an unintentional outflow of a hydraulic fluid flowing through the spool assembly from an inner cavity of the spool assembly in a first flow through an opening and a second flow though the opening of the spool assembly associated respectively with a first operating connection and a second operating connection;

wherein the spool assembly has a first position, a second position, a third position, a fourth position and a fifth position, wherein the hydraulic fluid flows from the first operating connection to the second operating connection when the spool assembly is in the first position or the second position, wherein the hydraulic fluid does not flow between the first operating connection and the second operating connection when the spool assembly is in the third position, wherein the hydraulic fluid flows from the second operating connection to the first operating connection when the spool assembly is in the fourth position or the fifth position, wherein the first operating connection and the second operating connection are opened and closed according to a position of the spool assembly, and wherein the first check valve and the second check valve are axially arranged in the spool.

15. The hydraulic valve according to claim 14, further comprising:

a tank connection, wherein the tank connection is open when the spool assembly is in the first position or fifth position, and wherein the tank connection is closed when the spool assembly is in the second position, third position, or fourth position.

* * * * *